US005697190A

United States Patent [19]

Scribner

[11] Patent Number: 5,697,190

[45] Date of Patent: Dec. 16, 1997

[54] EARTH ANCHORED POLE APPARATUS

[76] Inventor: Marshall N. Scribner, 1805 E. Virginia Dr., Orlando, Fla. 32803

[21] Appl. No.: 555,986

[22] Filed: Nov. 13, 1995

[51] Int. Cl.[6] ..... F02O 27/42

[52] U.S. Cl. ..... 52/165; 52/298; 248/530

[58] Field of Search ..... 52/165, 298, 720.1, 52/292, 155, 169.9, 741.15; 403/164; 116/173, 174; 248/231.91, 508, 530

[56] References Cited

U.S. PATENT DOCUMENTS

| | | | |
|---|---|---|---|
| 1,101,307 | 6/1914 | McDonough | 52/298 |
| 3,879,907 | 4/1975 | Olson | 52/298 |
| 4,279,104 | 7/1981 | Classen | 52/298 X |
| 4,558,979 | 12/1985 | Andrews | 403/164 X |
| 5,082,231 | 1/1992 | Knowles | 52/298 X |
| 5,157,882 | 10/1992 | Soble | 52/165 X |
| 5,337,989 | 8/1994 | Apple | 52/165 X |
| 5,404,682 | 4/1995 | West | 52/165 |

*Primary Examiner*—Michael Safavi
*Attorney, Agent, or Firm*—William M. Hobby, III

[57] ABSTRACT

A pole and pole support for anchoring the pole to the earth is provided having an earth anchor having an earth attaching portion on one end and an attaching head on the other end thereof. The pole has a pole attaching member attached to one end and a pole to earth anchor attaching mechanism rotatably attaches the pole to the earth anchor by connecting the earth anchor attaching head to the pole attaching member such that the pole can rotate relative to the earth anchor. A support base has a flange plate having an upright support sleeve attached thereto which can be positioned over or around one end of the pole and over the earth anchor attaching mechanism and attaching head to hold the pole in an upright position while allowing the rotation of the pole. The support base can be attached to the pole for rotation therewith.

9 Claims, 2 Drawing Sheets

EARTH ANCHORED POLE APPARATUS

BACKGROUND OF THE INVENTION

The present invention relates to poles and to pole anchors and especially to a pole anchor that attaches a pole in a vertical position to the earth but allows the rotation of the pole relative to the earth anchor.

In the past, it has been common to anchor poles and posts to the earth merely by the digging of a post hole, placing the post therein, and filling with dirt therearound. When the post is being used for a fence, adjacent posts are attached together with rails so that they support each other. It has also been common to fill post holes with concrete to more thoroughly anchor the post. There have also been a variety of earth anchoring devices for anchoring posts in a vertical position to the earth without the digging or boring of a hole in the ground.

Typical prior art pole or post anchoring systems can be seen in the Edwards et al. U.S. Pat. No. 5,224,310, for a hand-installed landscape foundation which has an earth anchor having an auger or screw threads on one end for rotatably driving the earth anchor into the ground and then has a plate attached to the earth anchoring portion for supporting a lamp post thereto. The Lechner et al. U.S. Pat. No. 4,753,411, is a portable beach umbrella safety base which has a stake for driving into the sand and a fold-out base or pivotal struts to hold the staff of an umbrella on the beach. The Bruser et al. U.S. Pat. No. 4,688,969 is an electrical ground rod installation device having an auger end on a shaft which can be driven into the ground. The C. H. Garrette, Jr. et al. U.S. Pat. No. 3,318,560, is a mast assembly and ground engaging support for the mast assembly which has an auger extension from a housing along with handles which allows the auger to be rotated into the ground. The D. Brown U.S. Pat. No. 2,643,843, is a sand anchoring device which has vanes on one end which can be rotated to drive the stake into the ground. The Burk U.S. Pat. No. 1,672,927, is a fence post having a ground anchoring means along with a ground plate. The J. M. Welch U.S. Pat. No. 1,438,047, is a pole anchor which can be driven into the ground and has a base plate with a vertically extending post attachment. The Tourgee U.S. Pat. No. 377,337, is a post which has an extending screw type anchor along with supporting connected braces. The Cummings U.S. Pat. No. 348,383, is an iron fence post attached in the earth and the Newton U.S. Pat. No. 291,927, is a post base which is driven into the earth but has an earth engaging plate and a vertically extending post supporting channel which has a bolt extending therethrough for anchoring the post thereto.

In contrast to these prior patents for post anchors and self-anchoring posts, the present invention has an earth anchor which is rotatably connected to a pole so that rotation of the pole and the base does not loosen the earth anchor. This has an advantage when used in a game, such as a disc-golf game, where a variety of disks are hitting a pole mounted target. A rotating pole prevents the pole from coming loose or the moving of the position of the pole. This also allows for ease of relocating of the disc game target.

SUMMARY OF THE INVENTION

A pole and pole support for anchoring the pole to the earth is provided having an earth anchor having an earth attaching portion on one end and an attaching head on the other end thereof. The pole has a pole attaching member attached to one end and a pole to earth anchor attaching mechanism to rotatably attach the pole to the earth anchor by connecting the earth anchor attaching head to the pole attaching member such that the pole can be rotated relative to the earth anchor. A support base has a flange plate having an upright support sleeve attached thereto which can be positioned over or around one end of the pole and over the earth anchor attaching mechanism to hold the pole in an upright position while allowing the rotation of the pole. The support base is attached to the pole for rotation therewith.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
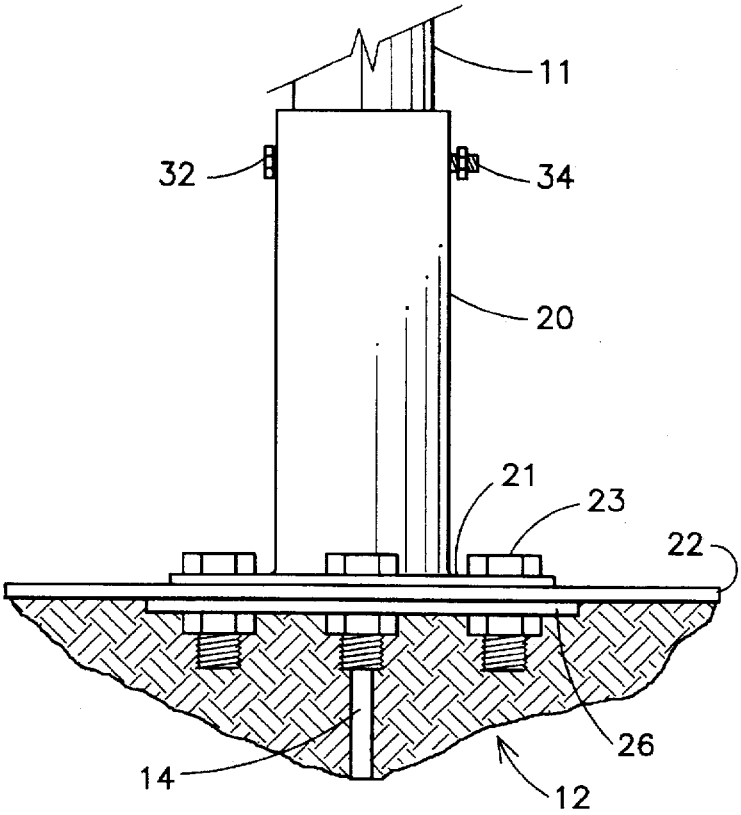
FIG. 1 is a side elevation of an anchored pole in accordance with the present invention.
Figure 5:
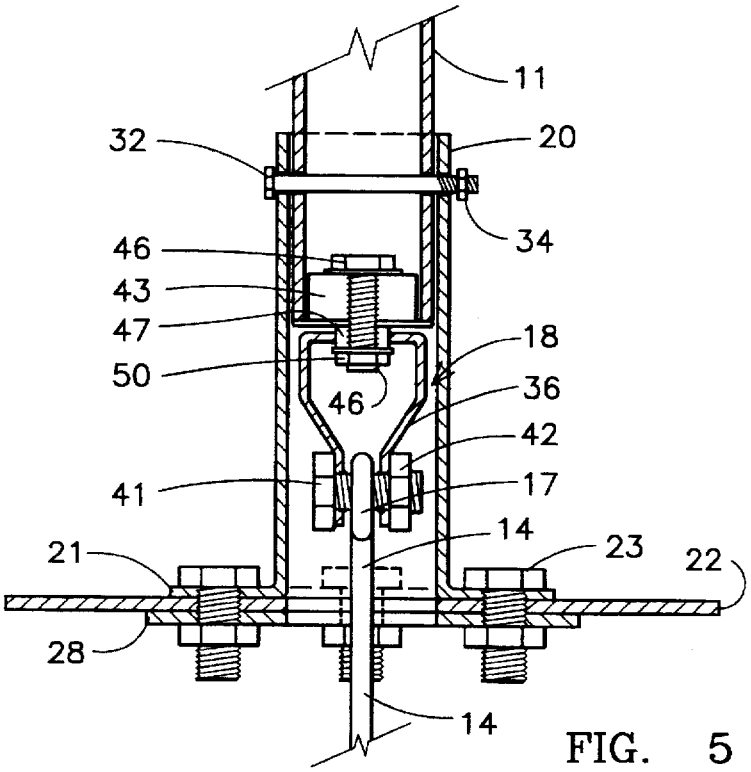
FIG. 5 is a sectional view taken through a portion of an anchored pole in accordance with the present invention.
Figure 4:
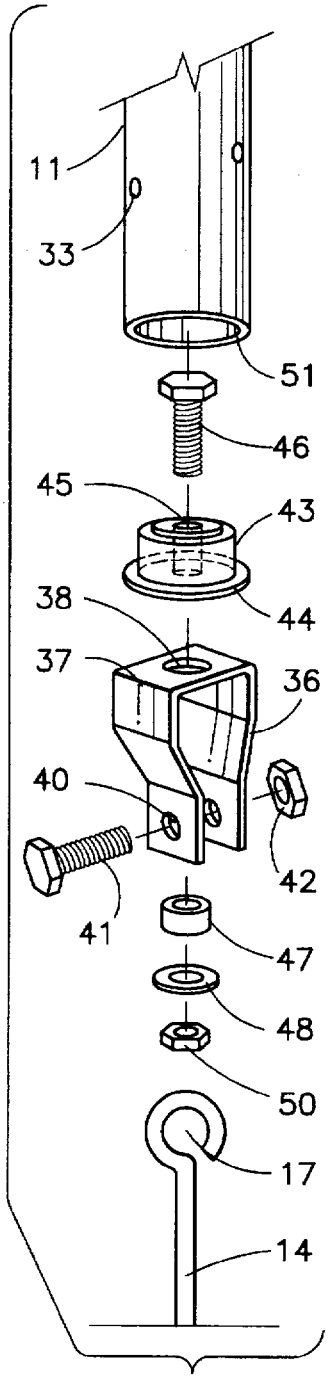
FIG. 4 is an exploded perspective view of the pole attaching mechanism.
Figure 2:
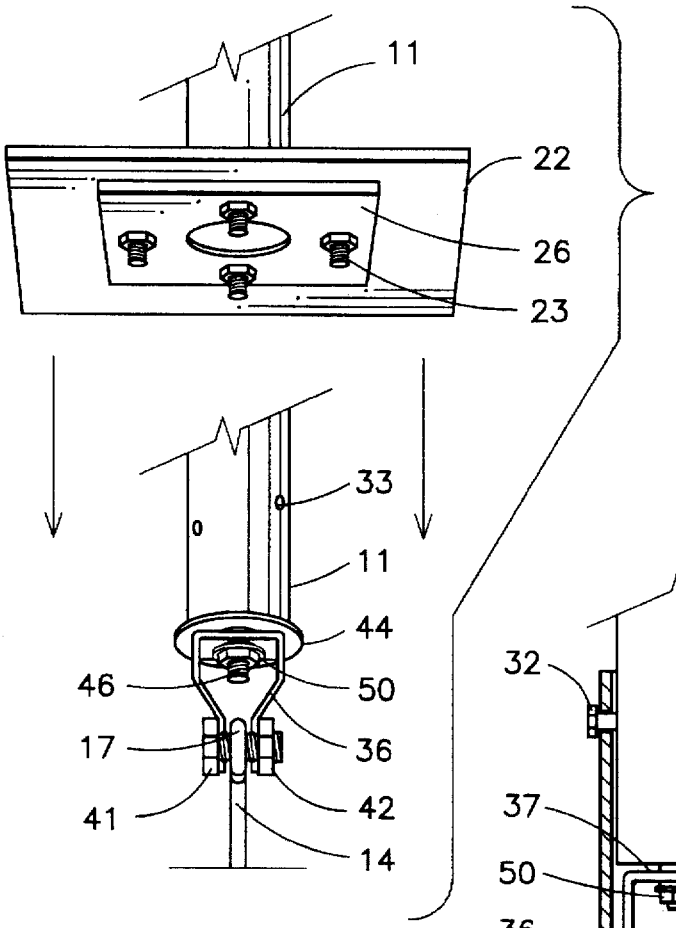
FIG. 2 is an exploded perspective of the pole support of FIG. 1.
Figure 3:
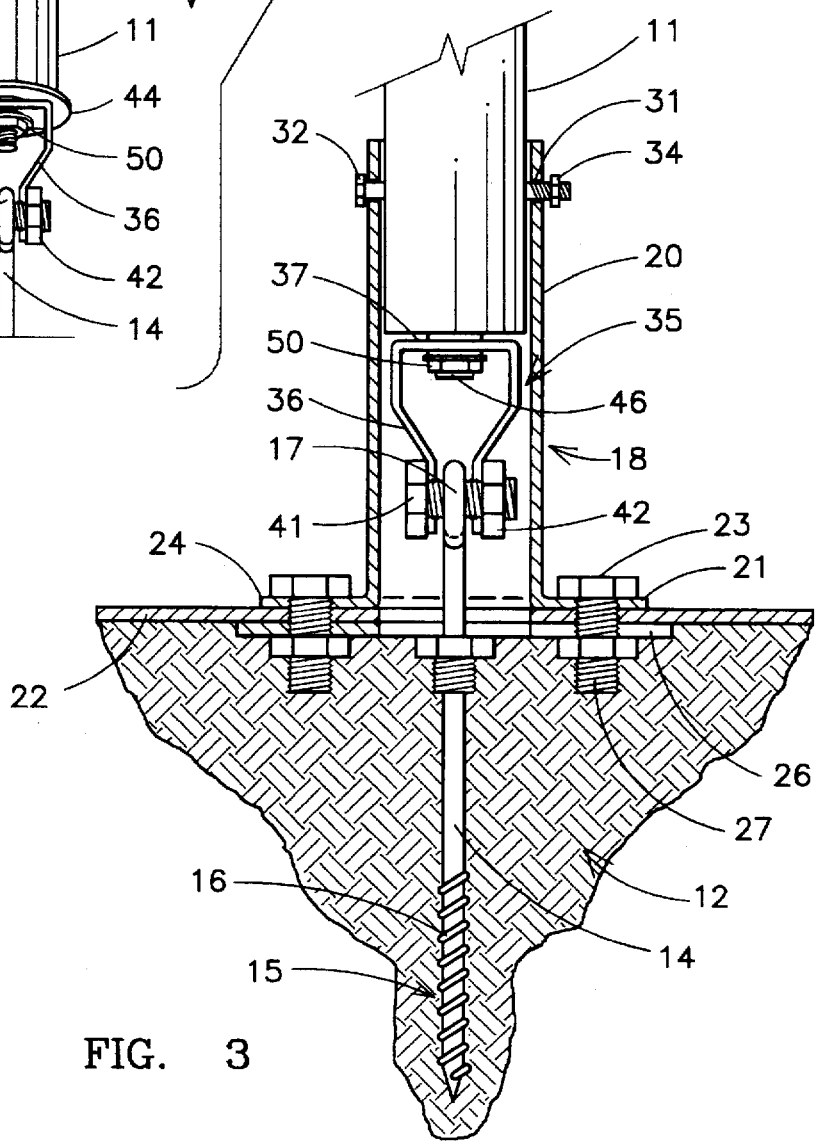
FIG. 3 is a sectional view of the pole support of FIGS. 1 and 2.

Referring to FIGS. 1–5 of the drawings, a pole and pole support is used for anchoring a pole 11 to the earth 12. The pole support includes an earth anchor 14 having an earth anchoring end portion 15 having a plurality of auger type threads 16 for rotatably driving the earth anchor 14 into the earth. The earth anchoring portion 14 has an attaching head 17, which is shown in the form of an eye, formed on the end of the anchor 14. A support base 18 includes a vertically extending sleeve 20 which has a flanged bottom 21 attached to a base plate 22 with bolts 23 passing through apertures 24 in the flange 21 and through the openings 25 in the base support plate 22. The bolts 23 are threadedly attached through a plate 26 through the bolt openings 27 and is attached with nuts. The upright sleeve also has at least two aligned openings 31 passing therethrough for supporting a pole locking bolt 32 therethrough and through a pair of openings 33 in the pole or post 11. The bolt 32 has a nut 34 for anchoring the pole 11 to the support sleeve 20.

A pole to earth anchor attaching mechanism 35 includes a yoke 36 having a squared off portion 37 having an aperture 38 therein. The yoke has a pair of aligned openings 40 through the yoke portion for accepting a bolt 41 therethrough and through the earth anchor head 17 where it is attached with the nut 42. The attaching mechanism 35 also has a cylindrical post attaching portion 43 having a flanged pressure plate area 44 and an aperture 45 passing axially therethrough for receiving a bolt 46 which passes through the pole attaching portion 43 and through the opening 38 and through a sleeve 47 and a washer 48 where it is locked with a nut 50, as shown more clearly in FIGS. 4 and 5.

Thus, the attaching mechanism 35 attaches the post 11 in such a manner that it can be rotated on the bolt 41 when the supporting base 18 is removed and can be shipped in a folded position or folded down when not in use. When the supporting base is placed over the post 11 attaching mechanism 18 and earth anchor 14 head portion 17, it is normally bolted with the bolt 32 to the sleeve 20. Thus, rotating the pole 11 rotates the sleeve 20 and the whole base portion 18 relative to the earth anchor 14 with the rotation turning on the axis of the bolt 46 with the flange 44 supported on the flat portion 37 of the yoke 36. The aligning sleeve 47 as well as a slip washer 48 are held to the bolt 46 with nut 50 and can rotate on the cylindrical support 43 with the base of the post 51 riding on the pressure plate flange 44. The pole 11 is slipped over the cylindrical support 43 and bolted thereto so that when the bolt 32 passes through the sleeve 20 and through the pole 11, it is locked onto the sleeve 43. It should also be clear that the cylindrical support 43 can be attached around the base of the post 51, such as having it made in two attachable portions, without departing from the spirit and scope of the invention. A person attempting to rotate the pole will merely rotate the pole and the base 18 without unscrewing the earth anchor 14 and the post will maintain its position.

It should be clear at this time that a pole support and earth anchor have been provided which advantageously allows the pole to be held in position and to resist the easy removal of the pole from the earth by the accidental or deliberate rotation of the pole and which pole anchor can be easily and quickly attached into the earth. However, the present invention is not to be considered limited to the forms shown which are to be considered illustrative rather than restrictive.

I claim:

1. An earth anchoring pole support and attached pole comprising:

an earth anchor having two ends, one end having an earth anchoring portion thereon and the other end having an attaching head thereon;

a pole having a two ends, one end having an attaching member thereon;

a rotatable attaching mechanism rotatably connecting said pole attaching member to said earth anchor attaching head around the elongated axis of said pole to thereby rotatably attach said pole to said earth anchor;

a support base having a base plate and a support sleeve attached perpendicular thereto, said support base support sleeve being mounted over said pole and said base plate being positionable on a generally flat surface, whereby a pole can be supported in a generally upright position and which allows rotation of said pole relative to said earth anchor.

2. An earth anchoring pole support and attached pole in accordance with claim 1 in which said earth anchor attaching head has an eye formed thereon.

3. An earth anchoring pole support and attached pole in accordance with claim 2 in which said rotatable attaching mechanism has a yoke movably bolted to said earth anchor attaching eye to thereby allow said pole to rotate on a perpendicular axis to the elongated axis of said pole.

4. An earth anchoring pole support and attached pole in accordance with claim 3 in which said rotatable attaching member includes a pressure support bearing surface having a pole attaching sleeve mounted inside one end of said pole.

5. An earth anchoring pole support and attached pole in accordance with claim 4 in which said support base support sleeve and said pole each have a pair of openings therethrough aligned to receive a bolt therethrough for locking said pole to said support base support sleeve.

6. An earth anchoring, pole support and attached pole in accordance with claim 5 in which said earth anchor earth anchoring portion includes an augur for threadedly attaching into the earth.

7. An earth anchoring pole support and attached pole in accordance with claim 6 in which said rotatable attaching mechanism yoke has a bolt opening extending therethrough and said pole attaching member has a bolt extending therefrom and through the yoke bolt opening for rotatably attaching said pole to said yoke.

8. An earth anchoring pole support and attached pole in accordance with claim 7 in which said upright support sleeve is removably bolted to said base plate.

9. An earth anchoring pole support and attached pole in accordance with claim 8 in which said pole is a cylindrical steel pole.

* * * * *